US009681695B2

(12) United States Patent
Beauchamp et al.

(10) Patent No.: US 9,681,695 B2
(45) Date of Patent: Jun. 20, 2017

(54) HELMET WITH CHIN CUP

(71) Applicant: Sport Maska Inc., Montreal (CA)

(72) Inventors: Pierre-Luc Beauchamp, St-Hippolyte (CA); Michel Lefebvre, Montreal (CA); Patrick Lefebvre, Montreal (CA); Sebastien Morin, St-Jerome (CA)

(73) Assignees: SPORT MASKA INC., Montreal, Quebec; LES EQUIPEMENTS DE GARDIEN DE BUT MICHEL LEFEBVRE INC., Terrebonne, Quebec ( * ) Notice: Subject to any disclaimer, the term of this patent is extended or adjusted under 35 U.S.C. 154(b) by 373 days.

(21) Appl. No.: 13/955,480

(22) Filed: Jul. 31, 2013

(65) Prior Publication Data

US 2015/0033455 A1 Feb. 5, 2015

(51) Int. Cl.
*A42B 3/08* (2006.01)
*A42B 3/20* (2006.01)

(52) U.S. Cl.
CPC ..... *A42B 3/08* (2013.01); *A42B 3/205* (2013.01)

(58) Field of Classification Search
CPC .... A42B 3/08; A42B 3/18; A42B 3/20; A42B 3/22; A42B 3/205; A42B 3/221; A42B 3/223; A42B 3/225
USPC ..... 2/425, 410, 909, 421, 424, 414
See application file for complete search history.

(56) References Cited

U.S. PATENT DOCUMENTS 2,908,911 A * 10/1959 Sowle ..... A42B 3/08 2/424
3,943,572 A * 3/1976 Aileo ..... A42B 3/166 2/209
3,990,113 A * 11/1976 Coenen ..... A42B 3/08 2/421
4,083,065 A * 4/1978 Warncke ..... A62B 18/04 2/424
4,398,306 A * 8/1983 Gooding ..... A42B 3/08 2/421
4,445,253 A * 5/1984 Howey ..... A42B 3/08 2/421
4,736,466 A * 4/1988 Kallstrom ..... A63B 71/10 2/427
4,741,054 A * 5/1988 Mattes ..... A42B 3/08 2/421
4,903,349 A * 2/1990 Arai ..... A42B 3/08 2/421
5,794,274 A * 8/1998 Kraemer ..... A42B 3/205 2/421

(Continued)

*Primary Examiner* — Anna Kinsaul
*Assistant Examiner* — Griffin Hall
(74) *Attorney, Agent, or Firm* — Norton Rose Fulbright Canada

(57) ABSTRACT

A protective helmet including a chin cup with a body and two opposed connecting arms, each connecting arm being connected to the helmet body through a connection allowing relative movement between the connecting arm and the helmet body. A fastening system is selectively movable between a first position where the fastening system restrains the relative movement between the connecting arm and the helmet body and a second position where the fastening system frees the relative movement between the connecting arm and the helmet body along the connection. A method of adjusting a position of a chin cup in a protective helmet is also disclosed.

14 Claims, 4 Drawing Sheets

(56) References Cited

U.S. PATENT DOCUMENTS 5,799,337 A * 9/1998 Brown ..... A42B 3/20 2/421
5,809,578 A 9/1998 Williams
5,915,538 A * 6/1999 Basson ..... A42B 3/08 2/421
5,946,735 A * 9/1999 Bayes ..... A42B 3/08 2/421
5,953,761 A * 9/1999 Jurga ..... A42B 3/145 2/414
6,189,156 B1 * 2/2001 Loiars ..... A42B 3/20 2/424
6,256,798 B1 7/2001 Egolf et al.
6,711,751 B1 * 3/2004 Muskovitz ..... A42B 3/04 2/10
7,146,652 B2 * 12/2006 Ide ..... A42B 3/08 2/422
7,152,253 B2 * 12/2006 Abelman ..... A42B 3/08 2/421
7,434,268 B2 * 10/2008 Futch ..... A42B 3/08 2/424
7,841,026 B2 * 11/2010 Makris ..... A42B 3/0433 2/410
7,886,370 B2 2/2011 Winningham
7,900,279 B2 * 3/2011 Kraemer ..... A42B 3/205 2/410
7,971,282 B2 * 7/2011 Berge ..... A42B 3/16 2/209
8,156,574 B2 * 4/2012 Stokes ..... A42B 3/145 2/417
2004/0040073 A1 * 3/2004 Morrow et al. ..... A42B 3/08 2/424
2006/0179537 A1 * 8/2006 Dennis ..... A42B 3/08 2/6.6
2009/0038055 A1 * 2/2009 Ferrara ..... A42B 3/14 2/421
2009/0107514 A1 4/2009 Winningham
2009/0265841 A1 * 10/2009 Ferrara ..... A42B 3/08 2/421
2011/0094018 A1 * 4/2011 Rogers ..... A42B 3/08 2/421
2012/0124721 A1 * 5/2012 Hampton, II ..... A42B 3/08 2/425
2013/0174332 A1 * 7/2013 Bryant ..... A42B 3/08 2/421

* cited by examiner

HELMET WITH CHIN CUP

TECHNICAL FIELD

The application relates generally to protective helmets and, more particularly, to chin protection in such helmets.

BACKGROUND OF THE ART

Some protective helmets include a mask protecting the face extending down to the chin. It is known to include a chin cup on such masks, made of protective material separately from the mask and usually attached in a fixed position within the mask to protect the chin.

However, helmets often have the possibility of adjusting their inner size, for example through adjustment between a front and rear shell, and accordingly the position of the chin cup may become less comfortable for some helmet sizes. Also, optimal position of a chin cup may vary between users.

SUMMARY

In one aspect, there is provided a protective helmet comprising: a helmet body adapted to cover at least part of a head of a wearer; and a chin cup for receiving a chin of the wearer, the chin cup having: a chin cup body defining an inner surface shaped to receive the chin and an opposed outer surface, two connecting arms engaged to the chin cup body with a respective one of the connecting arms extending from the chin cup body adjacent each one of two opposed sides thereof, each connecting arm being connected to the helmet body through a connection allowing relative movement between the connecting arm and the helmet body, and a fastening system selectively movable between a first position where the fastening system restrains the relative movement between the connecting arm and the helmet body and a second position where the fastening system frees the relative movement between the connecting arm and the helmet body along the connection.

In another aspect, there is provided a protective helmet comprising: a helmet body adapted to cover at least part of a head of a wearer; and a chin cup for receiving a chin of the wearer, the chin cup having: a chin cup body defining an inner surface shaped to receive the chin and an opposed outer surface, and two connecting arms engaged to the chin cup body with a respective one of the connecting arms extending from the chin cup body adjacent each one of two opposed sides thereof, each connecting arm being slidingly connected to the helmet body; the helmet body further including a respective fastening member extending adjacent each connecting arm and movable between a first position where the fastening member is engaged to the connecting arm and restrains sliding thereof relative to the helmet body and a second position where the fastening member is free of the connecting arm to allow sliding thereof relative to the helmet body.

In a further aspect, there is provided a method of adjusting a position of a chin cup in a protective helmet, the method comprising: moving a respective padding portion of the helmet to disengage the respective padding portion from a connecting arm extending from a side of the chin cup; moving the connecting arm along a connection between the connecting arm and the body of the helmet; and moving the respective padding portion back in engagement with the connecting arm to restrain relative movement between the connecting arm and the body of the helmet.

DESCRIPTION OF THE DRAWINGS

Reference is now made to the accompanying figures in which.

DETAILED DESCRIPTION

Figure 1:
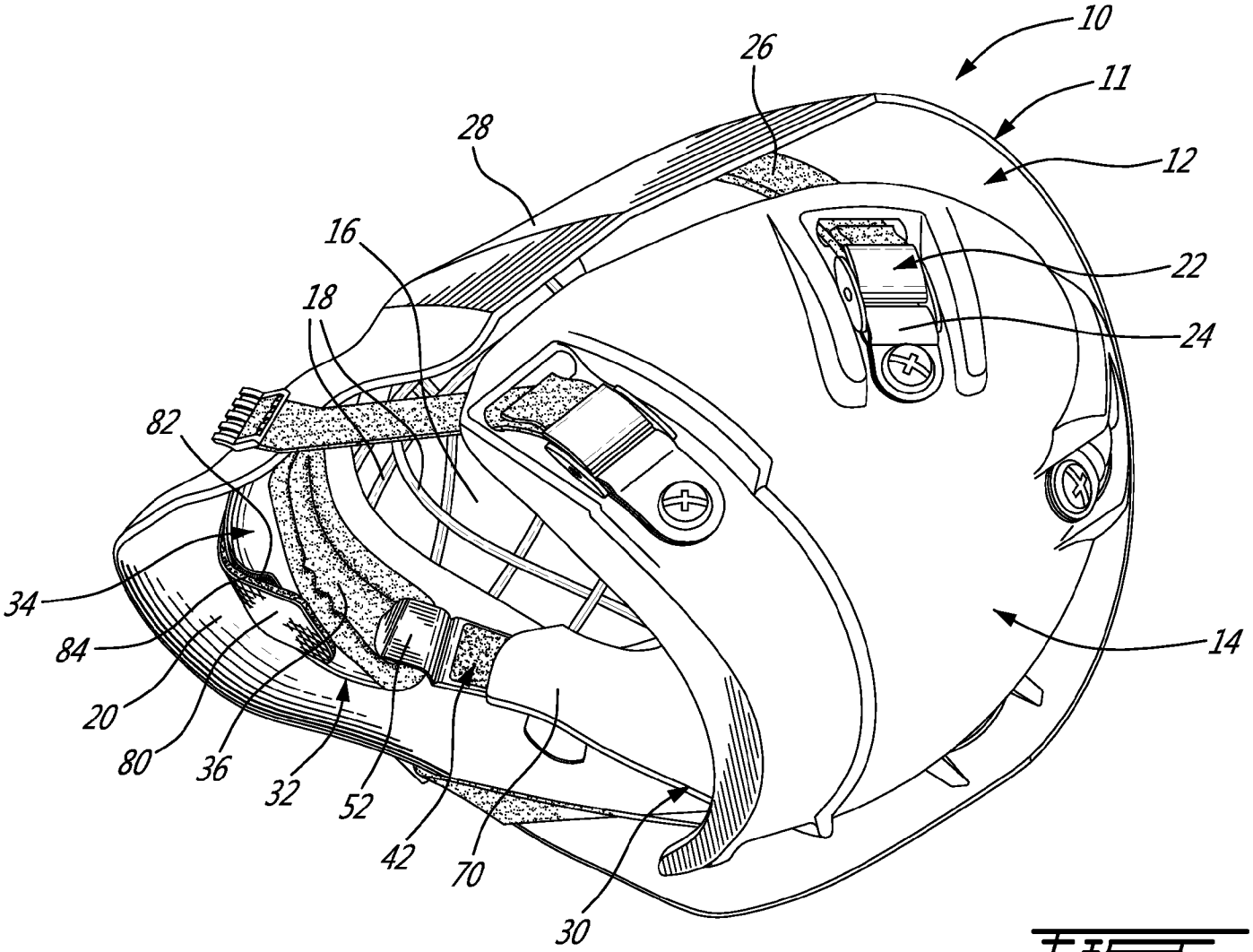
FIG. 1 is a schematic rear perspective view of a helmet including a chin cup, in accordance with a particular embodiment.
Figure 2:
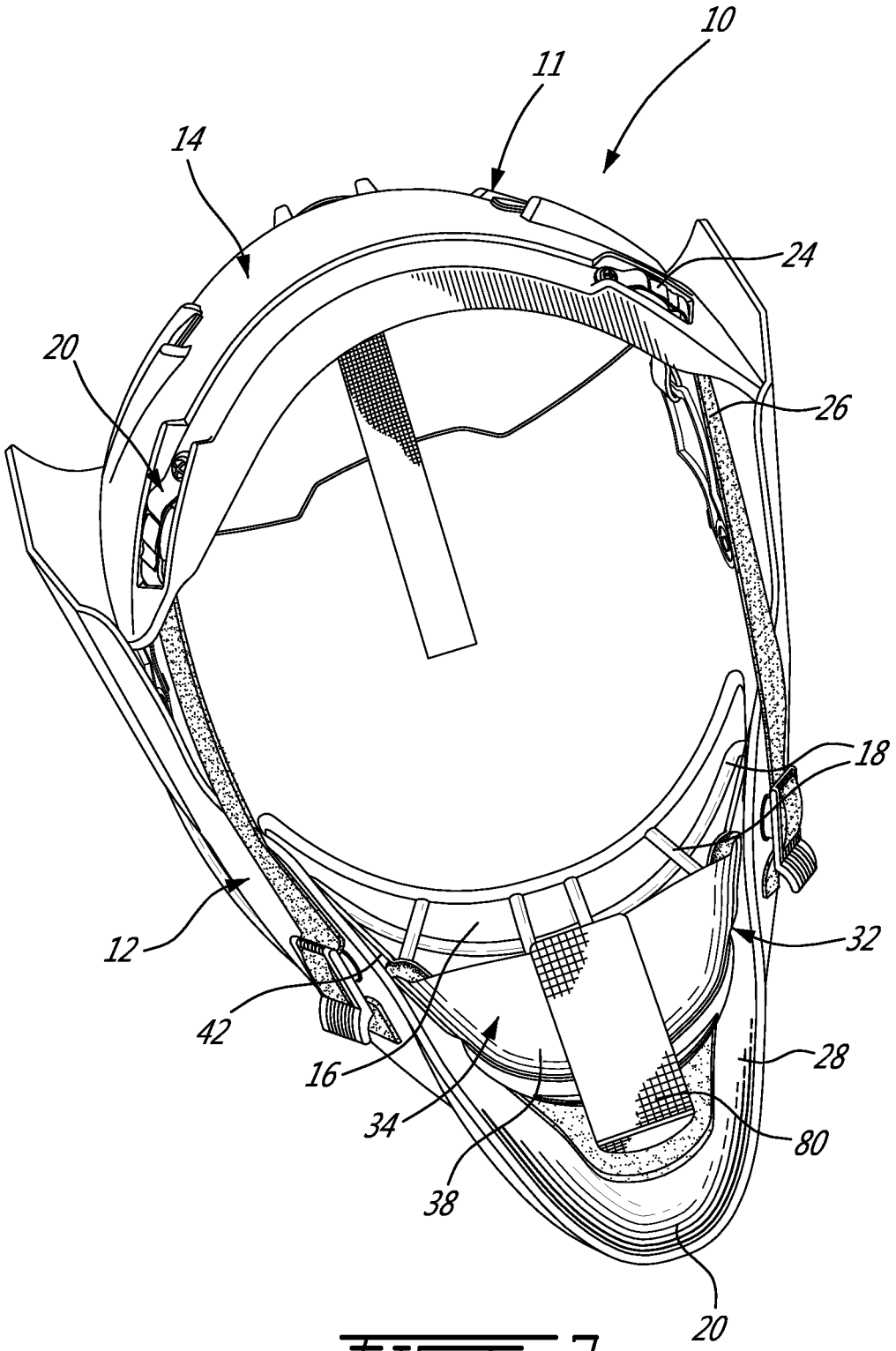
FIG. 2 is a schematic bottom view of the helmet of FIG. 1.

Referring now to FIGS. 1-2, a hockey goalie helmet is generally shown at 10. Although the helmet 10 is shown and described as a hockey goalie helmet, it is understood that the helmet 10 can alternately be any other type of protective helmet, including but not limited to a lacrosse helmet, a baseball helmet or a football helmet.

In the embodiment shown, the helmet 10 has a body 11 including a mask 12 and a back plate 14 which cooperate to surround the head of the wearer. In the embodiment shown, the mask 12 is adapted to substantially protect the face as well as a front portion of the head of the wearer. The mask 12 thus extends from the top of the head of the wearer to below the head to protect the jaw and neck, and rearwardly on the sides to cover the ears and rear part of the jaw. The mask 12 includes a window 16 defined therethrough, with a plurality of protection members 18 extending across the window 16 in criss-crossing fashion to prevent entry of foreign objects therethrough. A bottom portion 20 of the mask 12, under the window 16, extends over and below the chin of the wearer.

The back plate 14 is adapted to substantially cover a rear part of the head of the wearer. In the embodiment shown, in use, the back plate 14 extends partly inwardly of the mask 12 such as to ensure covering of the head at the junction between the mask 12 and back plate 14.

In the embodiment shown, the back plate 14 includes an adjustment mechanism 22 comprising adjustment members 24 connected to the back plate 14, and the mask 12 and back plate 14 are interconnected by straps 26 received in the adjustment members 24. In a particular embodiment, the helmet 10 can be adjusted while on the head of the wearer, by releasing one or more straps 26 from the respective adjustment member 24 such as to allow relative movement therebetween, adjusting the length of the one or more straps 26, and re-engaging the respective adjustment member 24. The straps 26 may be made of an elastic material; with straps having sufficient elasticity, the adjustment members 24 may be omitted. The straps 26 may be detachably connected to the mask 12, for example through a snap type fastener. Other types of attachment may be used.

It is understood that the configuration of the helmet body 11 shown is provided as an example only and that any other adequate configuration may alternately be used. For example, the mask 12 and back plate 14 may be interconnected through various types of connection members and/or the helmet body 11 may cover different areas of the head of the wearer than those of the embodiment shown.

In a particular embodiment, the mask 12 includes a rigid shell 28 and a padding layer 30 (see FIG. 1) secured to its inner surface. The shell 28 can be made of any type of adequate material, including but not limited to fiber reinforced materials, thermoplastics, and a combination thereof. The inner padding layer 30 can be made of any type of appropriate material, including but not limited to expanded foam such as for example expanded polypropylene (EPP), expanded polyethylene (EPE) or expanded polystyrene (EPS); fabric; any other adequate polymer; or any other material that may serve to absorb and/or limit the effects of a force applied on the helmet and/or provide comfort to the wearer.

Still referring to FIGS. 1-2, the helmet 10 includes a chin cup 32 which has an adjustable position within the bottom portion 20 of the mask 12. The chin cup 32 has a chin cup body 34 defining an inner surface 36 (FIG. 1) shaped (e.g. concave if the body 34 is rigid) and/or deformable to receive the chin of the wearer, and an opposed outer surface 38 (FIG. 2). In the embodiment shown, the outer surface 38 is convex; other configurations are also possible.

In a particular embodiment, the body 34 of the chin cup 32 includes an outer layer made of rigid material, such as an appropriate type of foam, and an inner layer made of a different, more flexible material, such as another appropriate type of foam. Alternately, the body 34 may be made of a single material, and/or may be provided in the form of a sling or strap instead of a body having a curved shape as shown. Examples of materials which may be used include, but are not limited to appropriate types of foams (e.g. ethylene vinyl acetate (EVA), polytethylene (PE), polyurethane (PU), expanded polypropylene (EPP), vinyle (VN)); silicone; thermoplastic polyurethane (TPU); leather; high density polyethylene (HDPE); polypropylene (PP); nylon; acrylonitrile butadiene styrene (ABS); or other similar materials.

Figure 3:
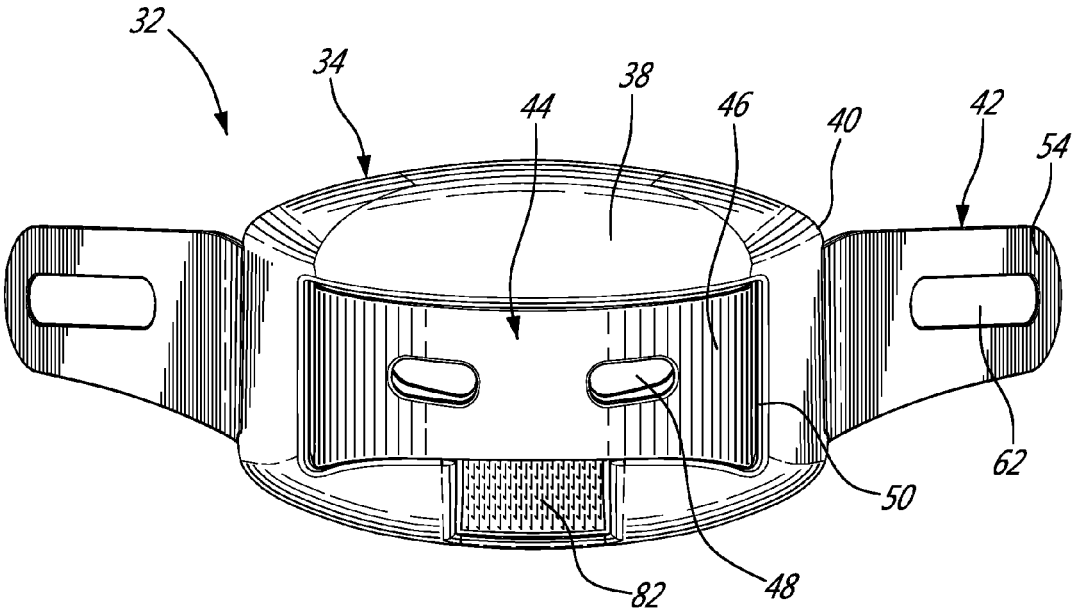
FIG. 3 is a schematic front view of a chin cup in accordance with a particular embodiment, which may be used in a helmet such as shown in FIGS. 1-2.
Figure 4:
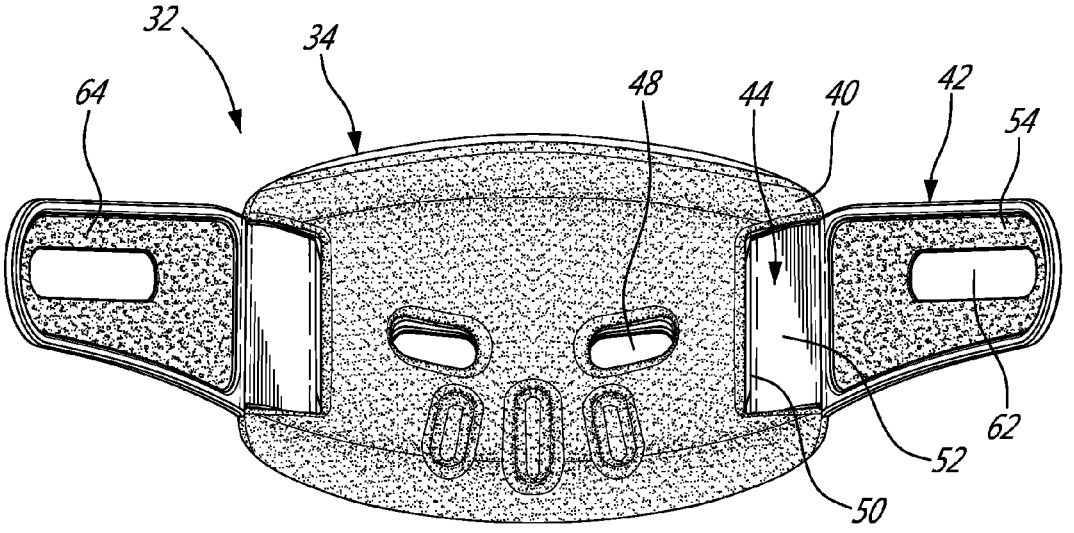
FIG. 4 is a schematic rear view of the chin cup of FIG. 3.

Referring to FIGS. 3-4, the chin cup body 34 defines two opposed side edges 40, and the chin cup 32 further includes two spaced apart connecting arms 42 which are engaged to the chin cup body 34 and extend away therefrom. In the embodiment shown, the connecting arms 42 extend rearwardly away from a respective one of the side edges 40, and are angled such that a distance therebetween increases toward their free end, to follow the profile of the bottom portion 20 of the mask 12 against which they are received (see FIGS. 1-2).

In the embodiment shown, a same elongated connecting member 44 includes the two connecting arms 42 and a central portion 46 (FIG. 3) extending between the two connecting arms 42. The central portion 46 extends over and is contoured to follow the profile of the outer surface 38 of the chin cup body 34. In the embodiment shown, the chin cup body 34 and central portion 46 both have aligned ventilation holes 48 defined therethrough. The chin cup body 34 has a slot 50 defined therethrough adjacent each of the two side edges 40, and the connecting member 44 extends through theses slots 50 such that the connecting arms 42 extend away from the inner side of the chin cup body 34. The connecting member 44 is sized to be snugly received in the slots 50, and the end 52 of each connecting arm 42 extending from the central portion 46 (see FIGS. 1 and 4) is contoured to follow the profile of the adjacent inner surface 36 of the chin cup body 34.

It is understood that the slots 50 may be omitted or configured differently, and/or the connecting arms 42 may be otherwise engaged to the chin cup body 34. For example, the connecting arms 42 may be provided as separate members independently connected to the chin cup body 34, for example to the outer surface 38 or the inner surface 36 thereof, and attached thereto through any appropriate mechanism including, but not limited to, glue, stitching, or an overmolding or co-injection process.

Figure 5:
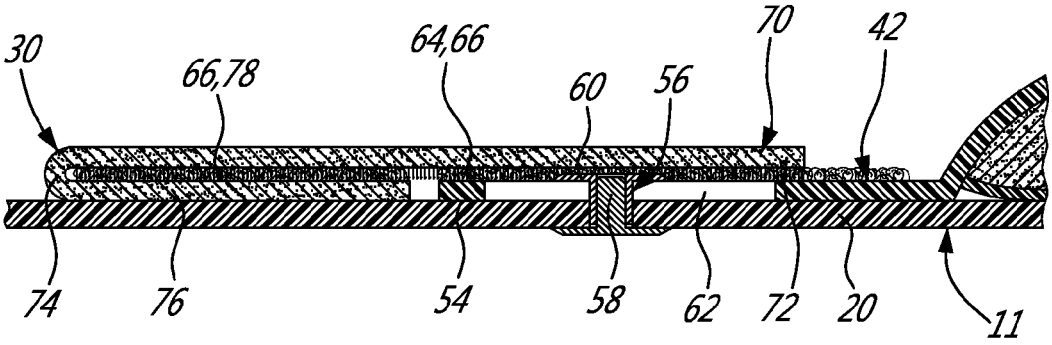
FIG. 5 is a schematic cross-sectional view of part of a helmet in accordance with a particular embodiment, showing part of the chin cup with the fastening member of the helmet in an engaged position therewith.
Figure 6:
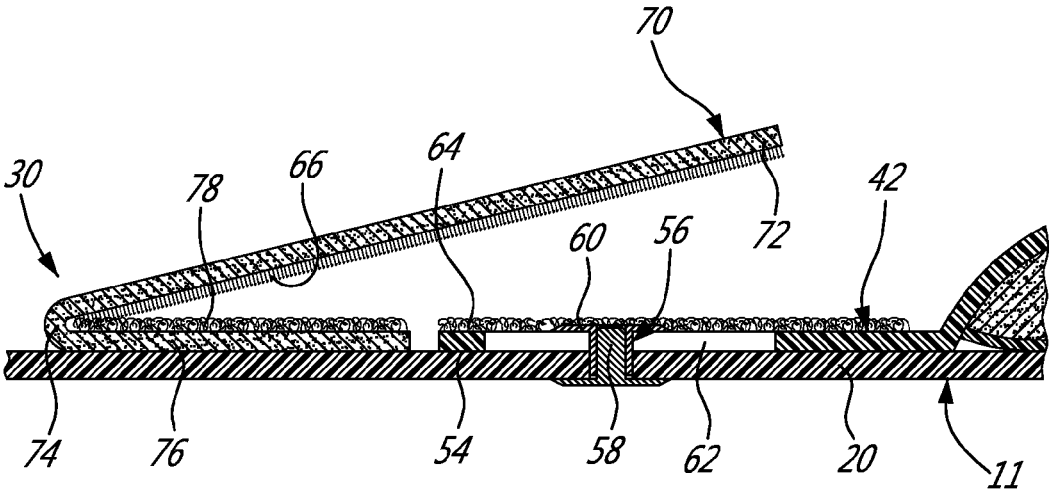
FIG. 6 is a schematic cross-sectional view of the helmet of FIG. 5, showing the fastening member of the helmet in a disengaged position.

Referring to FIGS. 5-6, the end 54 of each connecting arm 42 extending away from the chin cup body 34 is connected to the helmet body 11, in the embodiment shown to the bottom portion 20 of the mask shell 28, through a connection which allows relative movement between the connecting arm 42 and the helmet body 11. In the embodiment shown, the connection is a sliding connection. A respective pin member 56 has a shaft 58 extending from the inner surface of the shell 28, and supporting an enlarged head 60. Each connecting arm 42 includes an elongated slot 62 (see also FIGS. 3-4) defined longitudinally therethrough, and the slot 62 is sized to slidingly receive the shaft 58 of the pin 56 while having smaller cross-sectional dimensions than that of the head 60, to prevent the head 60 from passing therethrough; the pin and slot engagement accordingly allows a relative movement along the longitudinal direction of the connecting arm 42, as can be seen in FIGS. 5-6. In a particular embodiment, the pin 56 is detachable from the shell 28 to allow removal of the chin cup 32 from the helmet 10.

A fastening system is provided for each connecting arm 42, to restrain or prevent the relative movement between the connecting arm 42 and the helmet body 11. Each fastening system thus includes two complementary and detachably connectable fastening members 64, 66, one of the fastening members 64 being attached to the connecting arm 42, and the other fastening member 66 being attached to the shell 28 or to an element connected thereto.

In the embodiment shown, the padding layer 30 is connected to the shell 28 along a portion thereof only; the padding layer 30 includes at least one free padding portion 70 on each side, having a free end 72 movable relative to the shell 28 and located in proximity of the respective connecting arm 42. The opposed connected end 74 of each free padding portion 70 is retained (whether permanently or removably) to the shell 28 and/or to another section of the padding layer 30 attached to the shell 28, and the free padding portion 70 is free to move about the connected end 74. In a particular embodiment, the motion is provided through the flexibility of the padding material. Alternately, the connection may be provided through a hinge member distinct from the material of the padding layer 30. The connection may be removable, such that the free padding portion 70 is completely detachable from the helmet body 11.

In the embodiment shown, each connecting arm 42 is at least partially overlapped by the respective free padding portion 70. The fastening member 66 of the helmet body 11 is provided on the surface of the free padding portion 70 facing and contacting the connecting arm 42, while the fastening member 64 of the connecting arm 42 is provided on the surface thereof facing and contacting the free padding portion 70. Thus, the fastening member 66 of the helmet body 11 is movable between a position in engagement with the connecting arm 42 and a position away from the connecting arm 42, due to the movement of the free padding portion 70.

In the embodiment shown, the padding layer 30 includes a fixed padding portion 76 adhered to the inner surface of the shell 28 in proximity of the connecting arm 42, and the free padding portion 70 is attached to the end of the fixed padding portion 76 furthest from the connecting arm 42, such that the free padding portion 70 folds over the fixed padding portion 76, and extends thereover as well as over the connecting arm 42. The fastening member 66 of the free padding portion 70 also extends to the part thereof overlapping the fixed padding portion 76, and the fixed padding portion is provided with a complementary fastening member 78 similar to that of the connecting arm 42. Accordingly, in the engaged position of FIG. 5, the free padding portion 70 is engaged to both the fixed padding portion 76 and the connecting arm 42 through the engaged fastening members 66, 78 and 64, 66.

In the embodiment shown, the fastening members 64, 66, 78 are complementary members of a hook and loop type fastening system such as Velcro™; as such, the contacting surfaces of the connecting arm 42 and of the free padding portion 70 (and, if applicable, the fixed padding portion 76) are each covered with a respective one of hooks and loops, such that the surfaces are detachably connectable to one another. In a particular embodiment, the surface of the connecting arm 42 (and of the fixed padding portion 76) is covered by the loops for increased comfort, as this surface is directed toward the face of the wearer.

In the embodiment shown, the hook/loop material is provided on the connecting arm 42 around the slot 62 and the free padding portion 70 covers the connection between the connecting arm 42 and the mask shell 28, i.e. the pin 56 engaged in the slot 62. Alternately, the connection between the connecting arm 42 and the mask shell 28 and the fastening system may be spaced apart from one another.

The fastening member 66 of the helmet body 11 need not be provided on the padding layer 30; alternately, it may be attached elsewhere on the helmet body 11, for example on the shell 28, and the location of the complementary fastening member 64 on the connecting arm 42 is accordingly selected such that the two members 64, 66 may be connected. Alternate types of fastening systems which may be used between each connecting arm 42 and the helmet body 11, whether provided on the padding layer 30 or elsewhere on the helmet body 11 include, but are not limited to, a fastening system also providing the movable/sliding connection between the connecting arm 42 and helmet body 11, such as a screw/nut engagement which may be slidingly received in a slot defined through the connecting arm 42 and/or the helmet body 11 and selectively tightened to prevent sliding; a screw/cam engagement; or a teeth/slot engagement; or other fastening systems distinct from the movable/sliding connection between the connecting arm 42 and helmet body 11, such as complementary fabric fastening members having a different configuration that hook and loops (e.g. mushroom shaped); a snap engagements with a plurality of studs in the connecting arm 42 and/or the helmet body to define multiple engagement positions; or a pin/hole engagement with a plurality of pins and/or holes defined in the connecting arm 42 and/or the helmet body to define multiple engagement positions (similar to the fastening system at the rear of a baseball cap).

In a particular embodiment, and referring back to FIGS. 1-2, an optional additional fastening system for the chin cup 32 in a direction transverse to that provided by the connecting arms 42 is provided. A strap 80 extends transversely to the connecting arms 42 and interconnects the chin cup body 34, for example along its outer surface 38, to the bottom portion 20 of the mask 12, with the strap 80 being detachably engaged to the chin cup body 34 to define an adjustable length between the chin cup body 34 and mask 12. The additional fastening system thus includes complementary and detachably interconnectable fastening members 82, 84: one member 82 (see also FIG. 3) is attached to the outer surface 38 of the chin cup body 34 and the other member 84 is attached to the end of the strap 80 extending away from the mask 12. In a particular embodiment, the additional fastening members 82, 84 are also complementary patches of hook and loop fasteners. The height and/or angle of the chin cup 32 may thus be adjusted by detaching the strap 80, and re-engaging the strap 80 when the chin cup 32 is at the desired position.

Referring to FIG. 3, in the embodiment shown, the central portion 46 of the connecting member 44 defining the connecting arms 42 extends over the fastening member 82 of the body's outer surface 38, such as to cover the strap 80 connected thereto. Other configurations are also possible.

In the embodiment shown, the chin cup body 34, connecting arms 42 and fastening systems are completely concealed inside the helmet 10 when the helmet 10 is worn, at least for some positions of the chin cup body 34 within the helmet 10. In a particular embodiment, the chin cup body 34 may be visible below the shell 28 at its lowest position within the helmet 10.

In a particular embodiment, the adjustable attachment of the chin cup 32 to the helmet body 11 allows for increased overall adjustability of the helmet 10 for the wearer. In a particular embodiment, the position of the chin cup 32 may be easily adjusted as required. In a particular embodiment, the free padding portion 70 overlaying the connection between the connecting arms 42 and the helmet body 11 provides for increase comfort by preventing the connection from contacting the face of the wearer.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

The invention claimed is:

1. A protective helmet comprising:

a helmet body adapted to cover at least part of a head of a wearer, the helmet body including a shell and a padding layer connected to an inner surface of the shell; and a chin cup for receiving a chin of the wearer, the chin cup having:

a chin cup body defining an inner surface shaped to receive the chin and an opposed outer surface, two connecting arms engaged to the chin cup body with a respective one of the connecting arms extending from the chin cup body adjacent each one of two opposed sides thereof, each connecting arm being connected to the helmet body through a connection allowing relative movement between the connecting arm and the helmet body along a longitudinal direction of the connecting arm, and a fastening system for each of the connecting arms, each fastening system including complementary first and second members, with the first member being provided on the padding layer and the second member being attached to the connecting arm, at least the first member being selectively movable between a first position where the first and second members are detachably interconnected and the fastening system restrains the relative movement between the connecting arm and the helmet body along the connection, and a second position where the first and second members are detached and the fastening system frees the relative movement between the connecting arm and the helmet body along the connection;

wherein the padding layer includes a respective free padding portion extending in proximity of each connecting arm, each free padding portion having a free end including the first member of the fastening system and movable with respect to the inner surface of the shell between the first and second positions.

2. The helmet as defined in claim 1, wherein each connecting arm extends at least partly between the inner surface of the shell and the respective free padding portion, each free portion including the first member of the fastening system on a surface thereof facing the inner surface of the shell and overlaying the connecting arm.

3. The helmet as defined in claim 1, wherein the helmet body includes a mask adapted to cover a face of the wearer and the mask includes a bottom portion adapted to cover a chin of the wearer, the chin cup body being received in the bottom portion with the outer surface facing the bottom portion.

4. The helmet as defined in claim 3, further comprising a strap interconnecting the bottom portion and the chin cup body intermediate the two connecting arms, the strap defining an adjustable length between the chin cup body and the bottom portion.

5. The helmet as defined in claim 4, further comprising an additional fastening system including complementary and detachably interconnectable first and second additional members, the first additional member being attached to the outer surface of the chin cup body and the second additional member being attached to the strap.

6. The helmet as defined in claim 1, wherein the helmet body includes a rigid shell, the connection between each connecting arm and the helmet body being defined by a pin member having a shaft with a first end connected to an inner surface of the shell and an opposed second end supporting a head, with the shaft of the pin member being slidingly received in a slot defined through the connecting arm, the head having larger cross-sectional dimensions than the slot such as to retain the shaft of the pin member engaged in the slot.

7. The helmet as defined in claim 1, wherein the first and second members of each fastening system are complementary members of a hook and loop fastening system.

8. The helmet as defined in claim 1, wherein the two connecting arms are defined by a single elongated member extending through and away from a respective slot defined through the chin cup body adjacent each side thereof.

9. A protective helmet comprising:

a helmet body adapted to cover at least part of a head of a wearer, the helmet body including a mask having a bottom portion adapted to cover a chin of the wearer; and a chin cup for receiving the chin of the wearer, the chin cup having:

a chin cup body defining an inner surface shaped to receive the chin and an opposed outer surface, the chin cup body being received in the bottom portion of the mask with the outer surface facing the bottom portion, and two connecting arms engaged to the chin cup body with a respective one of the connecting arms extending from the chin cup body adjacent each one of two opposed sides thereof, each connecting arm being slidingly connected to the helmet body to allow relative movement between the connecting arm and the helmet body along a longitudinal direction of the connecting arm;

the helmet body further including a respective fastening member attached to the helmet body and extending adjacent each connecting arm, each fastening member being movable between a first position where the fastening member is engaged to the connecting arm and restrains sliding thereof relative to the helmet body and a second position where the fastening member is free of the connecting arm to allow sliding thereof relative to the helmet body; and a strap interconnecting the bottom portion of the mask and the chin cup body intermediate the two connecting arms, the strap being detachably connectable to the chin cup body along a plurality of different relative positions defining an adjustable length of the strap between the chin cup body and the bottom portion of the mask.

10. The helmet as defined in claim 9, wherein the helmet body includes a shell and a padding layer connected to an inner surface of the shell, and the fastening member is provided on the padding layer.

11. The helmet as defined in claim 10, wherein the padding layer includes a respective free padding portion extending in proximity of each connecting arm, each free padding portion having a free end movable with respect to the inner surface of the shell and including the fastening member.

12. The helmet as defined in claim 11, wherein each connecting arm extends at least partly between the inner surface of the shell and the respective free padding portion, each free padding portion including the fastening member on a surface thereof facing the inner surface of the shell and overlaying the connecting arm.

13. The helmet as defined in claim 9, wherein each fastening member is one member of a hook and loop fastening system, the connecting arm including a complementary member of the hook and loop fastening system.

14. The helmet as defined in claim 9, wherein the two connecting arms are defined by a single elongated member extending through and away from a respective slot defined through the chin cup body adjacent each side thereof.

* * * * *